US005957657A

United States Patent [19]

Akita et al.

[11] Patent Number: 5,957,657

[45] Date of Patent: Sep. 28, 1999

[54] METHOD OF FORMING A COOLING AIR PASSAGE IN A GAS TURBINE STATIONARY BLADE SHROUD

[75] Inventors: Eiji Akita; Masahito Kataoka; Yasuoki Tomita; Wataru Kawai; Takashi Fukura; Hiroshi Asano, all of Takasago, Japan

[73] Assignee: Mitisubishi Heavy Industries, Ltd., Tokyo, Japan

[21] Appl. No.: 09/145,237

[22] Filed: Sep. 1, 1998

Related U.S. Application Data

[63] Continuation-in-part of application No. 08/861,517, May 22, 1997, abandoned.

[30] Foreign Application Priority Data

Feb. 26, 1996 [JP] Japan ..... 8-37887

[51] Int. Cl.[6] ..... F04D 29/38

[52] U.S. Cl. ..... 415/115; 219/69.17

[58] Field of Search ..... 415/115, 116, 415/134–139; 219/121.12, 121.18, 69.17

[56] References Cited

U.S. PATENT DOCUMENTS

| | | |
|---|---|---|
| 3,841,786 | 10/1974 | Florjancic . |
| 3,890,685 | 6/1975 | Runte . |
| 4,017,213 | 4/1977 | Przirembel . |
| 4,142,824 | 3/1979 | Anderson . |
| 4,288,201 | 9/1981 | Wilson . |
| 4,780,051 | 10/1988 | Fisher, Jr. . |
| 4,940,388 | 7/1990 | Lilliker et al. . |
| 5,263,820 | 11/1993 | Tubbs . |

OTHER PUBLICATIONS

U.S. application No. 08/862,135; Mori et al., filed May 22, 1997.

U.S. application No. 08/862,181; Yuri et al., filed May 22, 1997.

U.S. application No. 08/861,517; Akita et al., filed May 22, 1997.

U.S. application No. 08/861,539; Takeishi et al., filed May 22, 1997.

U.S. application No. 08/861,753; Tomita et al., filed May 22, 1997.

U.S. application No. 08/862,146; Tomita et al., filed May 22, 1997.

U.S. application No. 08/862,161; Mori et al., filed May 22, 1997.

U.S. application No. 08/861,518; Hashimoto filed May 22, 1997.

*Primary Examiner*—John Kwon

*Attorney, Agent, or Firm*—Wenderoth, Lind & Ponack, L.L.P.

[57] ABSTRACT

In a cooling air passage in a gas turbine stationary blade shroud a groove at a shroud end face is formed to extend along the shroud end face. An open portion of the groove is covered by a plug so as to form a cooling air passage. A cooling air passage in which the work accuracy is remarkably enhanced can thus be very easily worked. Preferably the cooling air passage is formed by electric discharge machining (EDM). The same process can be used to form an open portion of the groove, as well as any desired turbulators. The open portion of the groove is closed by a plug which is brazed or welded in place.

14 Claims, 3 Drawing Sheets

METHOD OF FORMING A COOLING AIR PASSAGE IN A GAS TURBINE STATIONARY BLADE SHROUD

This is a Continuation-in-Part application of Ser. No. 08/861,517, filed May 22, 1997 as of Sep. 1, 1998, now abandoned.

BACKGROUND OF THE INVENTION

1. Field of the Invention

The present invention relates to a working method of a cooling air passage for the flow of cooling air in a gas turbine stationary blade shroud.

2. Description of the Prior Art

As a high temperature gas turbine is being developed, the cooling of a shroud of gas turbine stationary blade is also becoming necessary. FIG. 2 shows an entire shroud and FIG. 3 shows a cross sectional view, taken on line 3—3 of FIG. 2, of a cooling air passage in the prior art provided in the shroud.

In FIG. 3, a cooling air passage 11 is provided, passing through a shroud 12 in an axial direction, below a seal groove 13 in which adjacent shrouds 12 fit with each other. As shown in FIG. 2, the cooling air passage 11 is very long as compared with its diameter. Therefore, in the working of the cooling air passage 11, a high grade working technology is required.

So, in order to drill the cooling air passage 11 long enough relative to its diameter, machining work, keeping away from the nearby seal groove 13, becomes necessary. But due to the length of the passage, machining work with precise accuracy is very difficult.

Further, in case a turbulator (cooling fin) is to be provided in the cooling air passage, working with accuracy will be almost impossible.

SUMMARY OF THE INVENTION

In order to resolve the problems in the prior art, it is an object of the present invention to provide a method for working such a cooling air passage securely and easily and to provide a gas turbine stationary blade shroud having a cooling air passage that has been so worked.

The present invention relates to a working method of a cooling air passage in a gas turbine stationary blade shroud and comprises the steps of working a groove at a shroud end face so as to extend it along the shroud end face and covering an opening portion of the groove with a plug so as to form a cooling air passage. Thus the cooling air passage of the shroud is made by a groove being formed with a side face being open, and the open portion of the groove is covered by a plug. Hence the work is done securely and easily, the work accuracy is remarkably enhanced as compared with drilling the shroud in the axial direction, and a desired cooling air passage can be easily obtained without interference with a seal groove.

Also, the present invention relates to a working method of a cooling air passage in a gas turbine stationary blade shroud that comprises the steps of working a groove at a shroud end face so as to extend along the shroud end face, forming a turbulator in the groove and then covering an opening portion of the groove with a plug so as to form a cooling air passage. Thus a groove is formed at and along the shroud end face, then a turbulator is formed in the groove, and finally the groove is covered by a plug so that an air passage is completed. Hence the forming work of the turbulator can be done extremely easily and the entire work proceeds smoothly, so that a desired cooling air passage can be easily obtained.

By such simple construction using the groove and a plug covering the groove, a gas turbine stationary blade shroud having a desired cooling air passage can be easily obtained. With a turbulator in the cooling air passage, a cooling air flowing in the cooling air passage is prevented from becoming a laminar flow, and an effective cooling air passage, excellent in heat transmission, in a gas turbine stationary blade shroud can be obtained.

According to a preferred embodiment of the present invention, the groove is formed by electric discharge machining from the side end face of the shroud. The same kind of process is also used to form the open portion of the groove for receiving the plug, as well as the turbulators. A first jig is used to machine the groove, while a second jig is used to machine the open portion or plug receiving portion. A third jig can be employed to form the turbulators as desired.

It is noted that the plug can be brazed or welded in place in the plug receiving portion.

DESCRIPTION OF THE PREFERRED EMBODIMENTS

Figure 1:
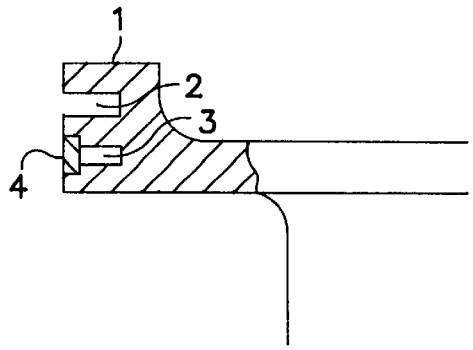
FIG. 1 is a cross sectional view showing a portion of a stationary blade shroud of one preferred embodiment according to the present invention.
Figure 2:
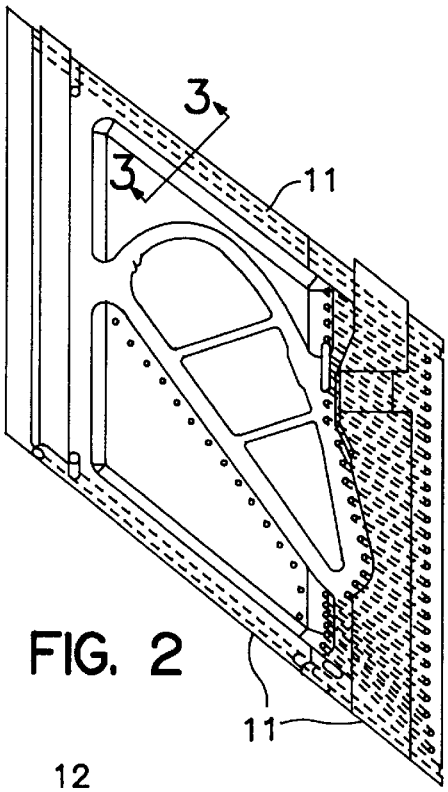
FIG. 2 is an explanatory view of the stationary blade shroud showing a cooling air passage arrangement therein.
Figure 3:
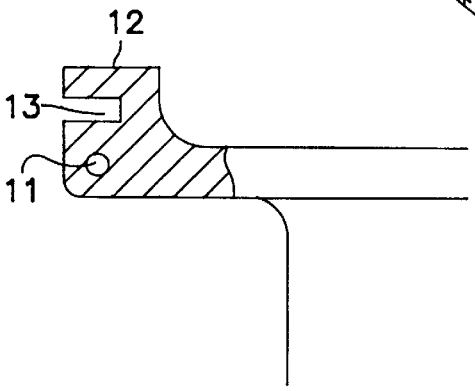
FIG. 3 (PRIOR ART)
FIG. 3 is a cross sectional view showing a portion of a stationary blade shroud in the prior art.
Figure 4A:
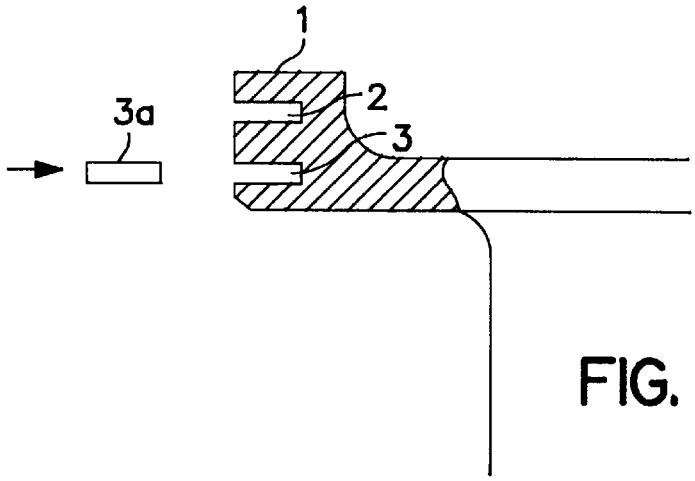
FIGS. 4(*a*)–4(*d*) are cross-sectional views illustrating a method of forming a cooling air passage arrangement according to the present invention.
Figure 4B:
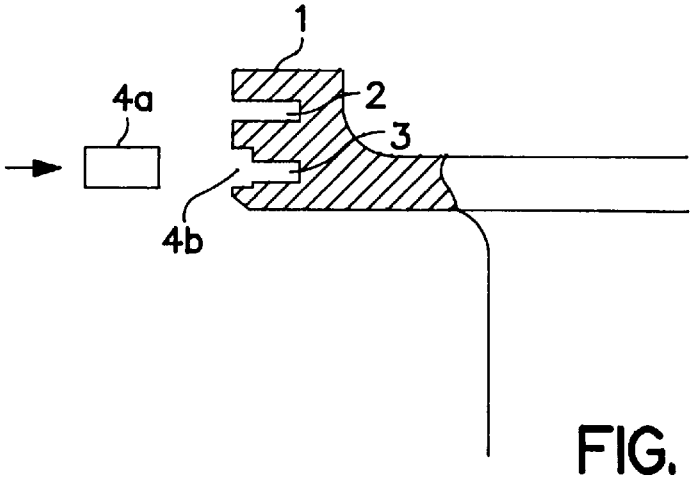
Figure 4C:
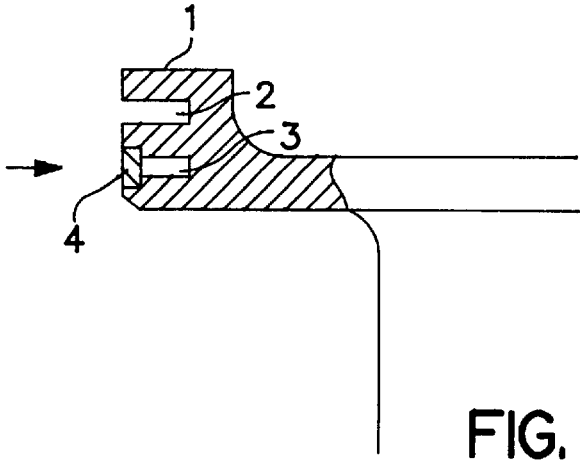
Figure 4D:
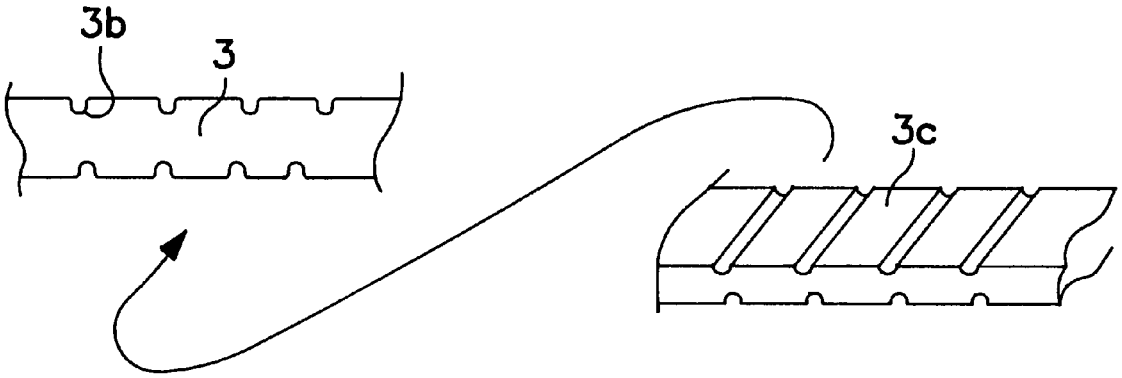

One preferred embodiment according to the present invention is described with reference to FIG. 1. FIG. 1 is a cross sectional view of a portion of a stationary blade shroud, and shows a portion corresponding to a cross section on line 3—3 of FIG. 2, described above.

At an end face of a stationary blade shroud 1, there is worked a seal groove 2 in which adjacent shrouds fit each other. There below a groove 3, as a cooling air passage, extending in a turbine axial direction along a shroud end face, is worked by use of a tool of convex shape.

Then, a plug 4 of plate shape is fitted in an opening portion of groove 3 along the axial direction. Brazing etc. is applied there around for closing so that a cooling air passage extending in the axial direction is completed.

According to the preferred embodiment as so made, the cooling air passage 3 can be easily worked with a side face of the shroud being open, the work accuracy is remarkably enhanced, and yet, according to the selection etc. of tools, even the formation of a passage having a turbulator becomes possible.

Incidentally, working the groove 3 by use of a convex shape tool was described above. But it would be easily understood that the cooling air passage can be formed angularly or roundly according to the selection of tool shapes, the selection of the moving directions of the tools (cutting directions), the selection of the plug shapes fitted in the opening portion of the groove 3, the working of the inner face of the plug, the combination of these selections, etc.

Although the preferred embodiment according to the present invention, shown in the figure, was described, the present invention is not limited thereto but naturally may be added to with various modifications with concrete structures within the scope of the present invention.

According to the present invention, working of the cooling air passage becomes remarkably facilitated and the work accuracy can be greatly enhanced.

Also, according to a further feature of the invention, a passage having a turbulator becomes possible and even the shapes the cooling passages can be variously selected. Hence the cooling performance of the shroud end portion can be enhanced, which has a large effect of contributing more greatly to the enhancement of gas turbine performance.

Also, according to a further feature of the invention, by use of a gas turbine stationary blade shroud having a cooling air passage of such a very simple structure as a combination of a groove and a plug covering the groove, a desired cooling effect can be easily obtained.

Also, according to another feature of the invention, a turbulator is formed within the cooling air passage. Thereby the cooling air flowing in the cooling air passage becomes turbulent, and is not in a state of laminar flow, and the cooling effect can be further enhanced.

According to a preferred embodiment of the present invention, the work of forming the groove is done by electric discharge machining (EDM). This method is used for forming both the groove itself and the portion that receives the plug 4, as will be described below.

Turning to FIGS. 4(*a*)–4(*d*), a method of forming a groove 3 according to the present invention will be described. The groove is formed by EDM from the shroud side end face. A jig or electrode 3*a* used in EDM is chosen to have a shape corresponding to that of the desired groove, and approaches the side end face of the shroud for working the groove 3 of the cooling air passage, as seen in FIG. 4(*a*). A plug receiving portion 4*b* as illustrated in FIG. 4(*b*) is formed by a corresponding jig 4*a*. The jig 4*a* approaches in a similar direction, shown by the arrows in the Figures.

After the formation of the groove 3 and the plug receiving portion or opening portion 4*b*, the plug 4 is fitted from the arrow direction. The plug 4 can be brazed or welded in place.

As illustrated in FIG. 4(*d*), if a turbulator is to be provided in the cooling air passage, a jig 3*c*, for example, can be chosen. This jig is provided with suitable formations so as to form corresponding turbulators 3*b* along groove 3. The step of forming the turbulators 3*b* with the jig or electrode 3*c* is carried out between the step of forming the groove with the jig or electrode 3*a*, and the step of forming the opening portion or plug receiving portion 4*b* with the jig 4*a*.

It is noted that the forming work of the groove in the opening portion, and turbulators as necessary, is done by EDM from the side end face of the stationary blade shroud. The fitting work of the plug is also done from the side end face.

Formation of the groove 3 by EDM from the shroud end face side is a relatively easy process that takes approximately several minutes, it is highly accurate, and substantially no failure of the work can take place, such as happens with inclined drilling and breaking through from the side end face. This is because the work can be done by seeing the work piece directly.

The fitting of the plug to the opening portion or the plug receiving portion is easily done by brazing or welding over approximately several minutes. Formation of the cooling air passage together with the fitting of the plug can thus be accomplished in ten and several minutes. This compares highly favorably with the prior art drilling operation, which takes several hours.

Furthermore, turbulators for enhancing the cooling effect can be easily worked with the above method. Prior art methods of forming the groove of the cooling air passage could not provide turbulators along the groove.

We claim:

1. A method of forming a cooling fluid passage in a gas turbine stationary blade shroud, comprising:

forming a cooling fluid groove in a side end face of a shroud of a stationary gas turbine blade such that the cooling fluid groove extends along the side end face of the shroud and has an open portion extending along the side end face of the shroud; and covering the open portion of the groove with a plug so as to form a cooling fluid passage, wherein said forming comprises electric discharge machining the side end face of the shroud to form said groove and said open portion.

2. The method of claim 1, and further comprising brazing the plug in position covering the groove.

3. The method of claim 1, wherein said forming takes place adjacent to a seal groove that extends along the side end face of the shroud in the same direction as the cooling fluid groove.

4. The method of claim 1, wherein said forming further comprises forming turbulators along said groove.

5. The method of claim 4, wherein said forming comprises electric discharge machining the side end face of the shroud to form said groove, said open portion and said turbulators.

6. The method of claim 1, wherein said forming comprises forming said open portion with a width wider than said groove and at said side end face, and said covering comprises placing said plug in said open portion.

7. The method of claim 1, wherein said forming comprises electric discharge machining of said open portion.

8. A method of forming a cooling fluid passage in a gas turbine stationary blade shroud of a gas turbine stationary blade comprising:

forming a cooling fluid groove in a side end face of a shroud of a stationary gas turbine blade, the side end face extending between an outer face and an inner blade face of the shroud, and the shroud having an axial direction, such that the cooling fluid groove extends axially along the side end face of the shroud and has an open portion extending axially along the side end face of the shroud; and covering the open portion of the groove with a plug so as to form a cooling fluid passage that extends axially through the shroud, wherein said forming comprises electric discharge machining the side end face of the shroud to form said groove and said open portion.

9. The method of claim 8, and further comprising brazing the plug in position covering the groove.

10. The method of claim 8, wherein said forming takes place adjacent to a seal groove that extends axially along the side end face of the shroud in the same direction as the cooling fluid groove.

11. The method of claim 8, wherein said forming further comprises forming turbulators along said groove.

12. The method of claim 11, wherein said forming comprises electric discharge machining the side end face of the shroud to form said groove, said open portion and said turbulators.

13. The method of claim 1, wherein said forming comprises forming said open portion having a width wider than said groove and at said side end face, and said covering comprises placing said plug in said open portion.

14. The method of claim 1, wherein said forming comprises electric discharge machining of said open portion.

* * * * *

UNITED STATES PATENT AND TRADEMARK OFFICE

CERTIFICATE OF CORRECTION

PATENT NO. : 5,957,657
DATED : September 28, 1999
INVENTOR(S) : Eiji Akita et al.

It is certified that error appears in the above-identified patent and that said Letters Patent is hereby corrected as shown below:

Column 5,
Line 1, change "1" to -- 8 --.

Column 6,
Line 1, change "1" to -- 8 --.

Signed and Sealed this

Seventh Day of August, 2001

*Attest:*

Nicholas P. Godici

*Attesting Officer*

NICHOLAS P. GODICI
*Acting Director of the United States Patent and Trademark Office*